US005438175A

United States Patent [19]

Herklotz et al.

[11] Patent Number: 5,438,175

[45] Date of Patent: Aug. 1, 1995

[54] ELECTRIC OUTLET ELEMENT HAVING DOUBLE FLASH

[75] Inventors: Günter Herklotz; Bernd Gehlert, both of Bruchköbel; Thomas Frey, Hanau, all of Germany

[73] Assignee: W. C. Heraeus GmbH, Hanau, Germany

[21] Appl. No.: 161,332

[22] Filed: Dec. 2, 1993

[30] Foreign Application Priority Data

Dec. 22, 1992 [DE] Germany ..... 42 43 570.6

[51] Int. Cl.[6] ..... H01H 1/02

[52] U.S. Cl. ..... 200/269

[58] Field of Search ..... 200/268, 269, 270, 266

[56] References Cited

U.S. PATENT DOCUMENTS

| | | | |
|---|---|---|---|
| 3,671,702 | 6/1972 | Penczek | 200/268 |
| 4,105,828 | 8/1978 | Borchert et al. | 200/268 X |
| 4,138,604 | 2/1979 | Harmsen et al. | 200/268 X |
| 4,328,286 | 5/1982 | Crosby | 200/268 X |
| 4,628,165 | 12/1986 | Nobel et al. | 200/268 |
| 5,066,550 | 11/1991 | Horibe et al. | 200/269 X |
| 5,139,890 | 8/1992 | Cowie et al. | 200/269 X |

FOREIGN PATENT DOCUMENTS

| | | | |
|---|---|---|---|
| 0247541 | 12/1987 | European Pat. Off. | 200/268 |
| 410472 | 1/1991 | European Pat. Off. . | |
| 2540944 | 3/1977 | Germany . | |
| 2839671 | 3/1980 | Germany | 200/269 |
| 3312713 | 10/1984 | Germany . | |
| 0154013 | 12/1980 | Japan | 200/269 |
| 0260721 | 10/1989 | Japan | 200/268 |

OTHER PUBLICATIONS

Whitlaw, Gold Flashed Palladium Nickel for Electronic Contacts, Trans IMF vol. 64, pp. 62–67 (1986).

Kudrack et al., "Porosity of Composite Palladium, Palladium-Nickel and Gold Electrodeposits," Plating and Surface Finishing, Feb. 1992, pp. 49–54.

*Primary Examiner*—Renee S. Luebke

*Attorney, Agent, or Firm*—Felfe & Lynch

[57] ABSTRACT

A thin galvanically deposited gold-containing surface layer is backed by a support layer containing a palladium alloy and having a thickness between 0.05 μm and 0.5 μm. In a preferred embodiment the surface layer and the support layer have a combined thickness of less than 0.5 μm.

12 Claims, 1 Drawing Sheet

ELECTRIC OUTLET ELEMENT HAVING DOUBLE FLASH

BACKGROUND OF THE INVENTION

The present invention relates to an electric contact element having a succession of layers comprising a base material, a contact layer and a thin galvanically deposited gold-containing surface layer.

Contact elements of this type are used, for example, in the fields of communications technology and data processing. With electric plug-in connections, they are configured, for example, as contact blade and contact clip. They distinguish themselves by the fact that their contact resistance is as low as possible and remains as constant as possible over an extended service life. Contact elements of the type comprising a base material, for example brass, and an overlying contact layer of palladium or palladium-nickel, upon which a surface layer of hard gold or soft gold is galvanically deposited, are being widely used. Contact elements of this type are known, for example, from the paper by E. J. Kudrak et al. published in "Plating and Surface Finishing", February 1992, pp. 49 to 54. The contact elements described by this publication comprise a contact layer of palladium or palladium-nickel of a thickness of between 0.25 and 2.5 μm and galvanically deposited surface layers of hard gold. The gold-containing surface layers, known as "flash", usually have a thickness of less than 0.5 μm.

A contact element of the kind from which this application starts out has been known also from DE-O-S 25 40 944. The contact element of this publication, which is intended for electric plug-in contacts, consists for example of a support comprising an easily soldering and welding intermediate layer, with an overlying contact layer of a silver-palladium alloy containing 30% by weight of palladium, on which a porous gold. layer of a thickness of 0.2 μm is galvanically deposited.

The gold-containing surface layer has proven its value, under aspects of their non-tarnishing properties, optimum maintenance of a constant contact resistance and maximum wear resistance, in connection with contact elements having contact surfaces of different materials, especially of alloys containing palladium. On the other hand, however, the gold-containing surface is a cost factor of considerable weight, especially for applications using a plurality of electric contact surfaces. However, due to the mechanical stresses acting on the contact element, and especially on the surface layers, during making and breaking of the electric contact, a certain minimum thickness is required for the surface layers of the known contact elements. Usually, a minimum thickness of approximately 0.20 μm is observed.

SUMMARY OF THE INVENTION

Now, it is the object of the present invention to provide a contact element which, compared with the before-mentioned type of contact elements, can be produced at lower cost with at least equivalent properties regarding corrosion and wear-resistance.

The invention achieves this object by the fact that the surface layer is backed by a support layer containing a palladium alloy and having a thickness in the order of between 0.05 μm and 0.5 μm.

The succession of layers comprising the support layer and the surface layer will be described hereafter as "double-flash". Electric contact elements comprising such a double-flash offer good corrosion and wear-resistance behavior. In fact, it has been found that contact elements with double-flash may offer a notably increased frictional-wear resistance as compared with prior-art contact elements, assuming identical thicknesses for the surface layer and the double-flash. This surprising effect is possibly due to the fact that the support layer provides a smooth and relatively hard base that allows relative movement of the gold-containing surface layer. This makes it possible for the surface layer to yield to forces of the kind that may act on it for example during contact-making and breaking, without the layer being damaged. Providing the contact element with a double-flash, therefore, enables the thickness of the gold-containing surface layer to be reduced, without the need to accept a deterioration of the element, for example as regards its frictional-wear resistance properties. In addition, the use of the cheaper precious metals silver and palladium, as compared with gold, enables the "double-flash" according to the invention to be produced at lower cost. Apart from this effect, the possibility to use a thinner gold-containing surface layer, as compared with the layer thicknesses of known contact elements, has also proven to be an advantage with respect to the wear-resistance of the gold-containing surface layer as such. This effect is also believed to result from the fact that a thinner gold-containing surface layer can yield to forces acting on it more easily, as compared with a thicker layer, so that fewer particles are worn off (reed formation), which abrasion may in turn contribute to accelerated frictional wear.

The electric contact element according to the invention comprises a support layer having a thickness in the range of between 0.05 μm and 0.5 μm. Support layers which are considerably thinner than 0.05 μm have been found to be ineffective as regards the corrosion and frictional-wear behavior of the contact element, whereas in the case of layer thicknesses of much more than 0.5 μm the possible savings in gold for the surface layer are balanced out by the higher consumption of the precious metals palladium and silver for the support layer.

Good results have been achieved especially with galvanically deposited support layers. These distinguish themselves not only by high homogeneity, high density and—as a result thereof—good corrosion and frictional-wear resistance, but also by the fact that they can be produced more easily and at lower cost, compared with sputtered layers.

Especially under the aspect of optimizing the production, preference is given to contact elements where the support layer has a thickness of less than 0.2 μm and the surface layer and the support layer together have a thickness in the range of between 0.1 μm and 1 μm, preferably less than 0.5 μm. The layer thickness of the gold-containing surface layer is preferably adjusted in this case to values of between 0.05 μm and 0.2 μm.

Especially good wear-resisting properties have been established for an embodiment of the electric contact element which comprises a support layer consisting of a palladium-silver alloy. Support layers of this type distinguish themselves by their hardness and smoothness. Preferred palladium-silver alloys are such where the silver content is in the range of between 20 and 70% by weight and the palladium content is in the range of between 30 and 80% by weight. Such precious metal alloys offer high corrosion-resistance and good frictional-wear behavior. They can be produced by galvanic processes. With respect to good tribological and chemical properties, and at the same time the least possible content of precious metals, a support layer of an alloy containing 50% silver and for the rest palladium is preferred.

In addition, contact elements comprising a support layer consisting of a palladium-nickel alloy, with a nickel content in the range of between 5 and 60% by weight, or of palladium-tin alloy with a tin content in the range of between 5 and 60% by weight, have also been found to be suitable.

According to a preferred embodiment of the contact element of the invention, the latter comprises a contact layer of palladium, a palladium-nickel alloy, a silver-tin alloy or of nickel-phosphorus. In the case of contact elements comprising contact layers of this kind, the double-flash structure has been found to be of particular advantage especially as regards the frictional-wear behavior of the contact element. It can be expected that similar improvements of the frictional-wear resistance will be observed for other contact elements with other contact surfaces, too, when a double-flash is used.

Advantageously, the contact layer and the support layer are arranged adjacent one to the other, it being however necessary in this case, in order to make use of the advantages provided by the double-flash, to use different materials for the contact layer and the support layer, respectively.

DETAILED DESCRIPTION OF THE PREFERRED EMBODIMENT

Figure 1:
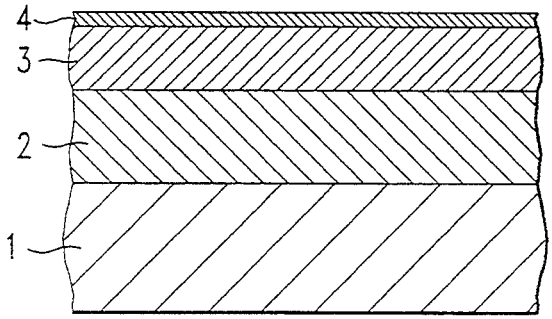
PRIOR ART FIG. 1
FIG. 1 shows a succession of layers of an electric contact element of the prior art.

Regarding the succession of layers represented in FIG. 1, the base material has been assigned the reference numeral 1. The base material 1, consisting of brass, is covered by an intermediate layer 2 of nickel that can easily be soldered or welded. On the intermediate layer 2, which has a thickness of 1.5 μm, a layer 3, being the contact layer, has been deposited. In the illustrated embodiment, it consists of palladium and has a thickness of 1 μm. On the contact layer 3, a surface layer 4 consisting of a cobalt-gold alloy of 0.2 μm has been galvanically deposited. Referring to the succession of layers illustrated in FIG. 2, materials and layer thicknesses identical to those described with reference to FIG. 1 are identified by the same reference numerals. The succession of layers illustrated in FIG. 2 differs from that of FIG. 1 only by the fact that the contact layer 3 is covered by a double-flash 5 instead of the surface layer 4 (FIG. 1). The layer of the double-flash 5, which faces the contact layer 3, is a galvanically deposited PdAg layer with a palladium and silver content of 50% by weight each. The PdAg layer 6 has a thickness of 0.1 μm. It is covered by a galvanically deposited surface layer 7 of a gold-cobalt alloy having a thickness of likewise 0.1 μm. Thus, the combined thickness of the double-flash 5 is 0.2 μm.

Hereafter, results obtained by frictional-wear measurements will be described by reference to FIGS. 3 and 4. For the purpose of determining the frictional wear, use was made of brass parts in the form of wafers and in the form of spherical caps of 3 mm radius. Both the wafers and the spherical caps had the very succession of layers that was to be measured as to its frictional-wear behavior. For purposes of these measurements, the spherical caps were moved to and fro on the wafers over a travel of 5 mm and at a frequency of 0.5 Hz until the coefficient of friction notably increased, which indicates that irreversible, abrasive and/or adhesive frictional wear has occurred.

The "coefficient of friction" measured as a function of the friction cycles performed, is a measure of the friction occurring when making or breaking an electric connection, for example by means of a plug-in connection. It is the result of the relation between the pushing and/or pulling forces occurring during making and breaking of the plug-in connection, and the contact pressure at which the two contact layers are pressed into face-to-face contact. A constantly low coefficient of friction is an indication of low frictional wear.

In the case of the curve shown in FIG. 3, the coefficient of friction of the succession of layers described by reference to FIG. 1 was measured as a function of the number of frictional cycles performed. The curve shows that the coefficient of friction, starting at an initial value of approximately 0.5, rises slightly after approximately 10 friction cycles performed, and then notably after approximately 80 friction cycles, reaching values of over 0.6. This indicates that particles have formed between the sliding surfaces, which then contribute to a rapidly increasing frictional wear.

Figure 2:
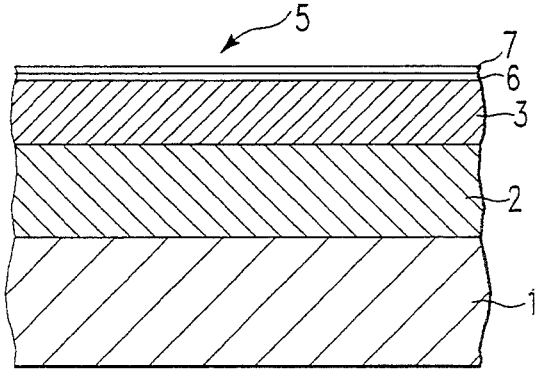
FIG. 2 shows a succession of layers of an electric contact element according to the invention.
Figure 4:
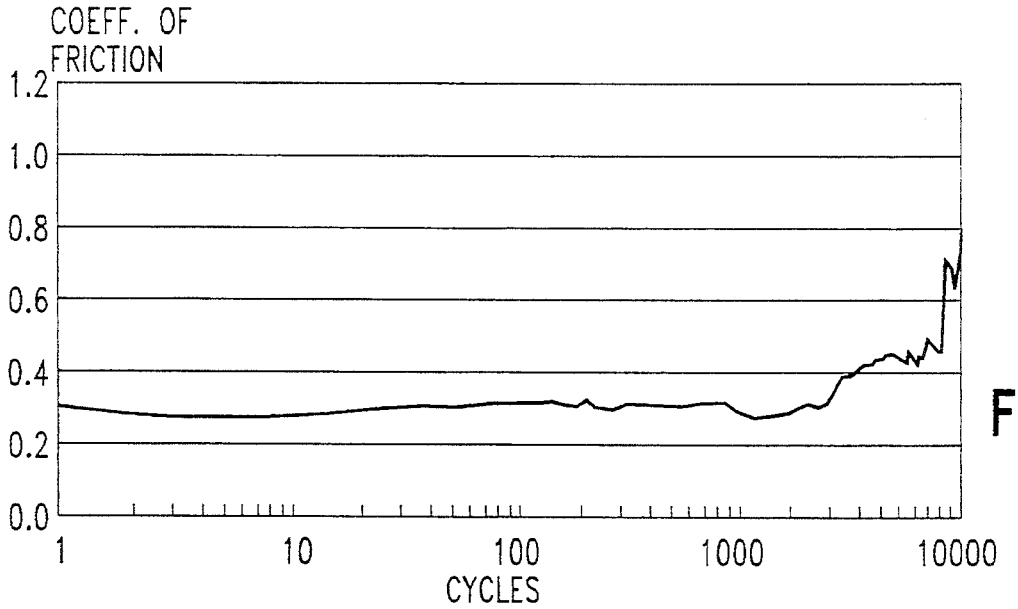
FIG. 4 shows the results of frictional-wear measurements conducted on a contact element having the succession of layers as represented in FIG. 2.

In the case of the curve shown in FIG. 4, the coefficient of friction of a contact element whose succession of layers includes the double-flash, as illustrated in FIG. 2, was measured as a function of the number of frictional cycles performed. The curve shows that the coefficient of friction, starting at an initial value of approximately 0.3, remains almost constant at a low level for more than 2000 friction cycles and commences to rise only thereafter.

Figure 3:
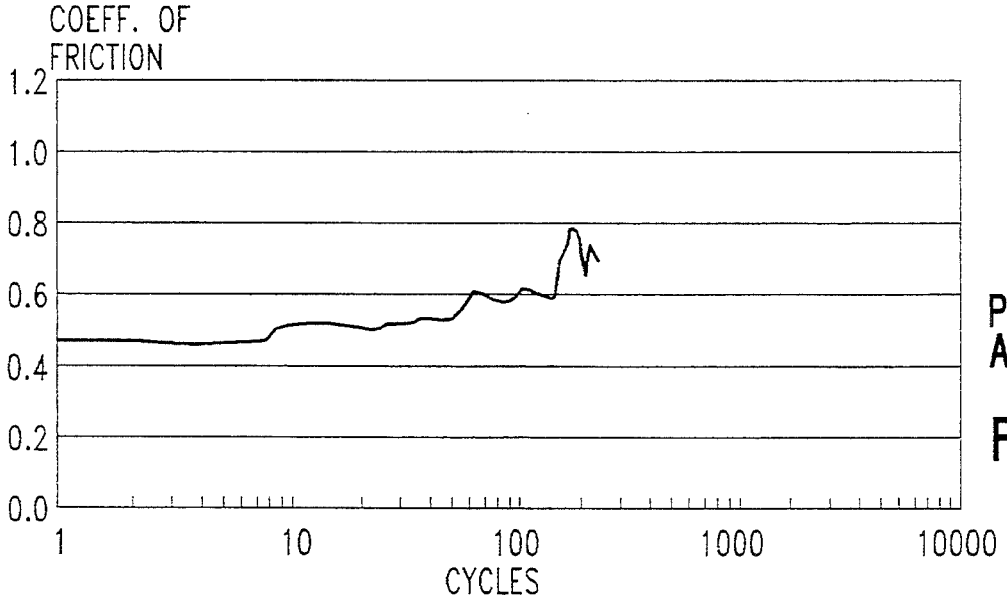
PRIOR ART FIG. 3
FIG. 3 shows the results of frictional-wear measurements conducted on a contact element having the succession of layers as represented in FIG. 1.

It is especially noted that the contact elements for which the measuring results represented in FIGS. 3 and 4 were obtained, differ only by the fact that in the case of the prior-art contact element illustrated in FIG. 3 the surface layer consists of a gold layer of 0.2 μm thickness, while in the case of the contact element according to the invention, as illustrated in FIG. 4, the surface layer is a double-flash consisting of a PdAg layer of 0.1 μm thickness and a gold layer of 0.1 μm thickness. The comparison of the measuring results clearly shows the positive effect which the PdAg layer, being only 0.1 μm thick, has on the frictional-wear behavior of the electric contact element according to the invention.

Similar measuring results were also obtained for contact elements with contact layers of palladium-nickel and silver-tin alloys, and of nickel-phosphorus, covered by a double-flash. It is to be expected that similar positive aspects of the double-flash will be obtained also when applied in combination with other contact layers.

We claim:

1. Electric contact element comprising a base, a contact layer over said base, said contact layer consisting of one material selected from the group consisting of palladium, a palladium-nickel alloy, and a silver-tin alloy, a support layer over said contact layer, said support layer consisting of a palladium alloy which is different from said material of said contact layer, said support layer having a thickness between 0.05 μm and 0.5 μm, and a gold containing surface layer directly over said support layer.

2. Contact element according to claim 1 wherein the support layer is galvanically deposited.

3. Contact element according to claim 1 wherein the support layer has a thickness of less than 0.2 μm.

4. Contact element as in claim 3 wherein said support layer has a thickness of 0.1 μm.

5. Contact element according to claim 1 wherein the surface layer and the support layer have a combined thickness of between 0.1 μm and 1 μm.

6. Contact element as in claim 5 wherein the surface layer and the support layer have a combined thickness of less than 0.5 μm.

7. Contact element according to claim 1 wherein the support layer consists of a palladium-silver alloy.

8. Contact element according to claim 7 wherein the support layer has a silver content in the range of between 20 and 70% by weight and a palladium content in the range of between 30 and 80 by weight.

9. Contact element according to claim 1 wherein the support layer consists of a palladium-nickel alloy, with a nickel content in the range of between 5 and 60% by weight.

10. Contact element according to claim 1 wherein the support layer consists of a palladium-tin alloy with a tin content in the range of between 5 and 60% by weight.

11. Contact element as in claim 1 further comprising an intermediate layer between said base and said contact layer.

12. Contact element as in claim 11 wherein said intermediate layer consists of nickel.

* * * * *

UNITED STATES PATENT AND TRADEMARK OFFICE

CERTIFICATE OF CORRECTION

PATENT NO. : 5,438,175

DATED : August 1, 1995

INVENTOR(S) : Günter Herklotz, et al.

It is certified that error appears in the above-identified patent and that said Letters Patent is hereby corrected as shown below:

On the title page,
In the Title; [54] for "OUTLET" read -- CONTACT --.

Signed and Sealed this

Thirtieth Day of April, 1996

*Attest:*

*Attesting Officer*

BRUCE LEHMAN

*Commissioner of Patents and Trademarks*